US006339946B1

(12) United States Patent
Yamashita et al.

(10) Patent No.: US 6,339,946 B1
(45) Date of Patent: Jan. 22, 2002

(54) PIPE FORMING APPARATUS AND METHOD

(75) Inventors: Michio Yamashita; Hideo Abe; Yoshiharu Daikuzono; Shingo Emi; Nobuo Tomizawa, all of Chiba (JP)

(73) Assignee: Kawasaki Steel Corporation, Hyogo (JP)

( * ) Notice: Subject to any disclaimer, the term of this patent is extended or adjusted under 35 U.S.C. 154(b) by 0 days.

(21) Appl. No.: 09/433,968

(22) Filed: Nov. 4, 1999

(30) Foreign Application Priority Data

Nov. 4, 1998 (JP) ..... 10-313206
Nov. 4, 1998 (JP) ..... 10-313207
Nov. 4, 1998 (JP) ..... 10-313208

(51) Int. Cl.[7] ..... B21D 5/14
(52) U.S. Cl. ..... 72/173; 72/170
(58) Field of Search ..... 72/173–175, 170, 72/169

(56) References Cited

U.S. PATENT DOCUMENTS 3,530,700 A * 9/1970 Marsh ..... 72/145
3,693,391 A * 9/1972 Mori ..... 72/173
4,030,335 A * 6/1977 Allenspach ..... 72/170
4,476,194 A * 10/1984 Sanborn ..... 72/171
4,796,449 A * 1/1989 Berne ..... 72/173
5,115,658 A * 5/1992 Kirchhoff ..... 72/175

FOREIGN PATENT DOCUMENTS

GB 743485 * 1/1956 ..... 72/173

* cited by examiner

*Primary Examiner*—Daniel C. Crane
(74) *Attorney, Agent, or Firm*—Young & Thompson

(57) ABSTRACT

In a pipe forming process using bending rolls, load applied to an upper roll is reduced to suppress the deflection of the upper roll, thereby suppressing creation of large end gap at the longitudinal center of the pipe, thus enabling production of high-strength, thick-walled elongated pipes. This is achieved either by (1) setting the roll spacing L between lower rolls to a value greater than the sum of the diameter Dwu of the upper roll 34 and the diameter Dwl of each of the lower rolls 32, and setting the amount S of tightening of the upper roll 34 with respect to the lower rolls 32 to a value greater than the radius Rwl of each of the plural rolls; or by (2) effecting pipe forming work on the sheet material such that the spacing L of the lower rolls 32 satisfies the following condition:

$$(Dp+Dwl)>L\geqq 0.85(Dp+Dwl),$$

where Dp represents the outside diameter of the product pipe and Dwl represents the diameter of one of the plural rolls; or by (3) preparing the sheet material having leading and trailing bent end regions bent beforehand over a length not smaller than ⅕ of the entire circumference of the pipe to be produced; and effecting bending by the bending rolls such that the length of the regions bent by the bending rolls is less than ⅗ the entire circumference of the pipe.

10 Claims, 18 Drawing Sheets

PIPE FORMING APPARATUS AND METHOD

BACKGROUND OF THE INVENTION

1. Field of the Invention

The present invention relates to a pipe forming apparatus which uses bending rolls, as well as to a pipe forming method and pipe formed by the apparatus or method. More particularly, the present invention relates to a pipe forming method which uses bending rolls including a pair of lower rolls arranged at one side of a sheet material and an upper roll arranged at the other side of the sheet material intermediate the pair of lower rolls, as well as to a pipe forming apparatus including the bending rolls and a pipe formed by the pipe forming apparatus or method. The pipe forming apparatus and method of the present invention are suitable for production of high-strength, thick-walled pipes.

2. Description of the Related Art

Mass production of pipes is generally carried out by using an electric welding mill when the pipe diameter is comparatively small, whereas UOE mills are used for pipes having comparatively large pipe diameters.

For small-lot production, however, a method as shown in FIG. 1 is employed for pipes having large wall thicknesses. More specifically, referring to FIG. 1, a blank sheet 10 is pressed between a bending die 22 and a pressing die 24 of a roll bender 20, and the pressing operation is repeated many times, e.g., 50 times or more, so as to bend the blank sheet into a pipe. In contrast, a method as illustrated in FIG. 2 is used when the wall thickness of the pipe is small. More specifically, referring to FIG. 2, a pyramidal roll bender 30 employs three rolls: a pair of lower rolls 32 disposed under a blank sheet 10 and driven by a motor (not shown) and an upper roll 34 disposed on the upper side of the blank sheet 10 at a position intermediate the pair of lower rolls 32. The tightening amount S, i.e., the extent to which the upper roll 34 is lowered, is adjustable. In operation, the blank sheet 10 is threaded between the upper roll 34 and the lower rolls 32 so as to be continuously bent at a curvature radius ρ.

A process of producing a pipe by the illustrated bending rolls is shown in FIG. 3. As the first step, cutting and groove work are conducted by means of a flame planer 40 which cuts a blank sheet by using an oxygen or other gas plasma. Then, an end bending operation is performed by, for example, a hydraulic press for bending the end of the blank sheet that cannot be bent by bending rolls. Then, bending is effected by using, for example, a pyramidal roll bender 30 having three rolls as shown in FIG. 2. Subsequently, inner/outer surface welder 46 performs tack welding and welding of inner and outer surfaces. Then, end face milling is performed by an end face mill (not shown). The pipe thus formed is then shot-blasted in a shot-blast apparatus (not shown) and sent for testing and inspection. In some cases, bend correction is performed subsequent to roll bending or tack welding, in order to enhance the circularity of the pipe. Such bend correction is conducted substantially in the same way as the roll bending.

The production of pipes using bending rolls is suitable for multi-variety and small-quantity production, because it is adaptable to a variety of pipe diameter through adjustment of the amount S of tightening of the upper roll 34. In addition, this type of pipe forming method is superior to methods using UOE mills, because of lower installation cost, and so forth.

On the other hand, this pipe forming method tends to allow an end gap 12A to occur in the center of the resulting pipe 12 as shown in FIG. 4, due to the difficulty of preventing deflection of the bending roll, especially the upper roll 34. Therefore, this method is not suitable for use in the production of high-strength, thick-walled elongated pipe, which places a heavy load on the rolls tending to cause deflection of the rolls.

This shortcoming arises because the upper roll 34 is supported only at its opposite ends and the outside diameter Dwu of the upper roll 34 is limited by the diameter of the product pipe, such that the roll diameter must be smaller than the pipe diameter due to a geometrical requirement. On the other hand, deflection of the lower rolls is controllable because backup rolls may be placed in support of the lower rolls at suitable positions.

The pipe production method using a press bender is more suitable for the production of thick-walled pipes than the pipe-production method using a roll bender, but has a drawback in that the production efficiency is low due to the need for many pressing cycles, resulting in an elevated cost of production.

FIG. 5 shows a pipe forming method which overcomes the above-described shortcoming of roll benders and which is disclosed in Japanese Kokai No. 53-128562. In this method, pressure is applied during forming a pipe to the upper roll 34 from the upper side thereof by means of a backup beam 36 via backup rolls 35.

With this method, deflection of the upper roll 34 is reduced so that the formation of the end gap is suppressed, thereby to facilitate production of high-strength, thick-walled elongated pipes.

As an alternative measure, it is possible to use an upper roll of a greater diameter in accordance with an increase in the diameter of the pipe to be produced, thereby enabling production of high-strength, thick-walled elongated pipes, by decreasing deflection of the upper roll.

These known methods, however, are not suitable for use in the production of relatively small-diameter pipes, although they are effectively used in the production of large-diameter pipes. This is because there is insufficient space available between the upper roll 34 and the inner surface of the pipe 12 for accommodating a backup beam 36 when the pipe diameter is relatively small, and a small-diameter upper roll thus must be used alone, since, as stated before, the outside diameter Dwu of the upper roll 34 is limited by the inside diameter of the pipe to be produced. For these reasons, production of small-diameter pipes tends to be accompanied by creation of an end gap, due to lack of a technique for suppressing deflection of the upper roll, such that the upper roll is often bent beyond an allowable limit.

SUMMARY OF THE INVENTION

Accordingly, an object of the present invention is to described before, by improving the product pipe configuration through reducing end gap which tends to appear at a longitudinally central portion of the pipe, without causing the roll to be bent or deflected beyond an allowable limit.

To this end, according to one aspect of the present invention, there is provided a pipe forming apparatus of the type using bending rolls including a plurality of rolls arranged on one side of a sheet material, and a counter roll arranged at the other side of the sheet material, comprising: a roll spacing setting device that sets the roll spacing of the pair of rolls to a range greater than the sum of the diameter of the counter roll and the diameter of one of the pair of rolls; and a device that sets the tightening amount of the counter roll relative to the pair of rolls to a range greater than the radius of one of the pair of rolls.

The above object of the invention is achieved by forming the sheet material into a pipe with the pipe forming apparatus while setting the roll spacing between the pair of rolls to a value greater than the sum of the diameter of the counter roll and the diameter of each of the pair of rolls, and setting the amount of tightening to a value greater than the radius of each of the pair of rolls.

In order to achieve the above object, the present invention in its second aspect provides a pipe forming method for forming a pipe using bending rolls including a plurality of rolls arranged on one side of a sheet material, and a counter roll arranged at the other side of the sheet material, the pipe forming method comprising: effecting pipe forming work on the sheet material such that the spacing L of the pair of rolls satisfies the following expression:

$$(Dp+Dwl)>L\geqq 0.85(Dp+Dwl) \quad (1)$$

where Dp represents the outside diameter of the product pipe and Dwl represents the diameter of one of the pair of rolls.

To achieve the foregoing object, the present invention in its third aspect provides a pipe forming method for forming a pipe using bending rolls including a plurality of rolls arranged on one side of a sheet material, and a counter roll arranged at the other side of the sheet material, the pipe forming method comprising: preparing the sheet material having leading and trailing bent end regions bent beforehand over a length not smaller than ⅕ of the entire circumference of the pipe to be produced; and effecting roll bending such that the length of the regions bent by the bending rolls is less than ⅗ the entire circumference of the pipe to be produced.

These and other objects, features and advantages of the present invention will become clear from the following description of preferred embodiments when read in conjunction with the accompanying drawings.

DESCRIPTION OF THE PREFERRED EMBODIMENTS

First Aspect of the Invention

Figure 1:
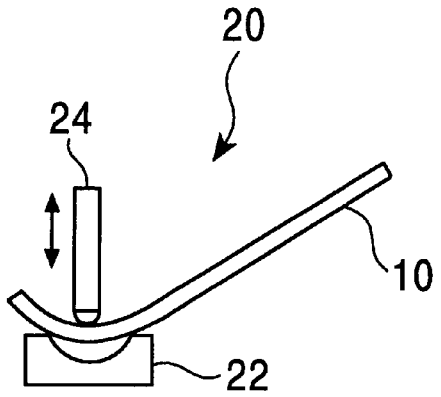
FIG. 1 is a front elevational view of a conventional arrangement for producing a steel pipe with a press bender.
Figure 2:
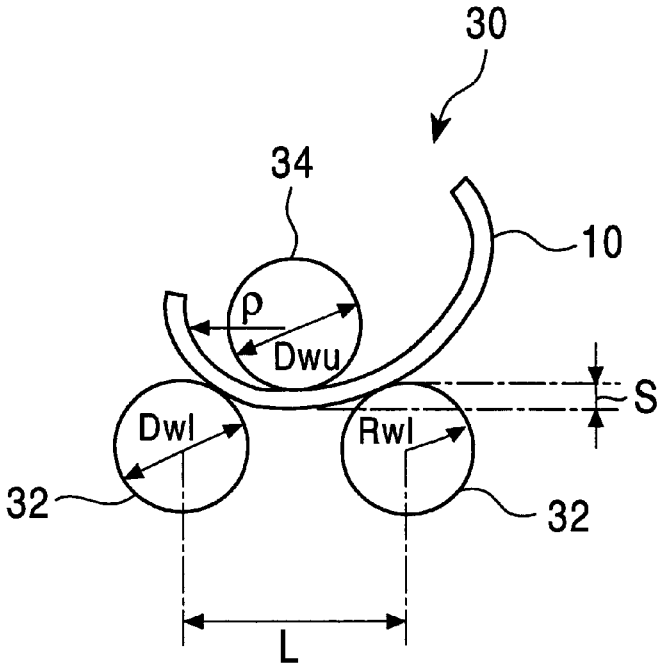
FIG. 2 is a front elevational view of a known arrangement for producing a steel pipe with a roll bender.
Figure 6:
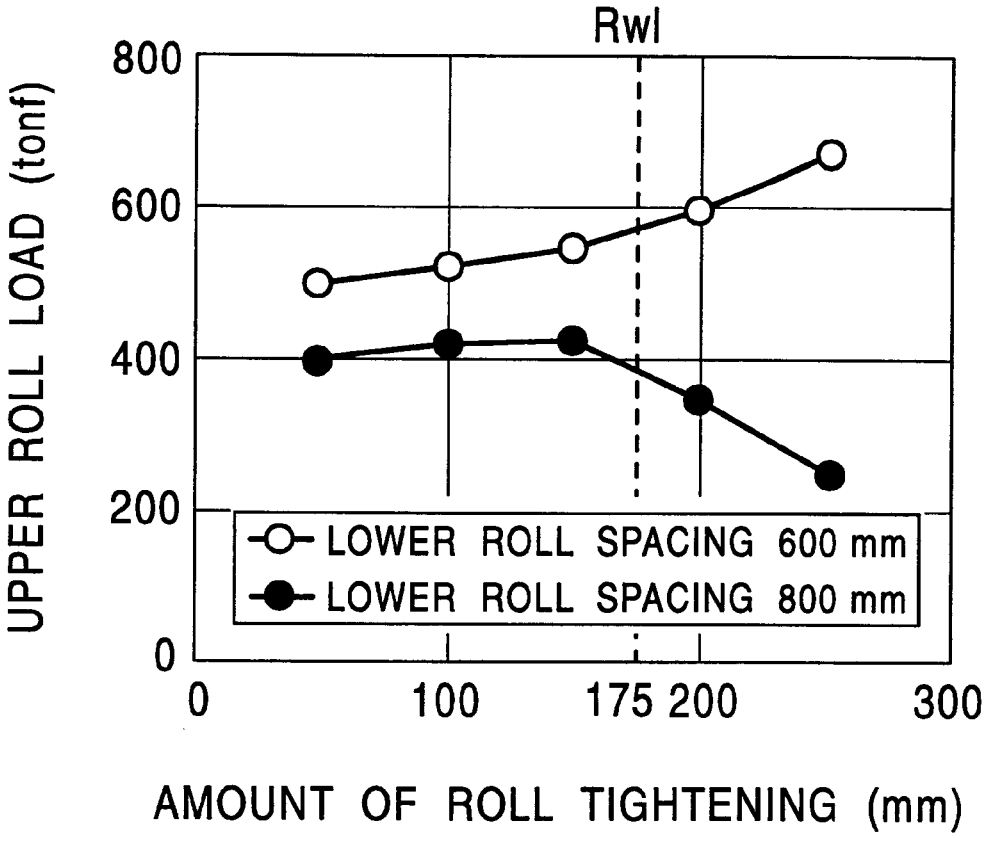
FIG. 6 is a diagram showing the relationship between the extent of lowering of an upper roll and the load acting on the upper roll, illustrating a principle of the present invention.

FIG. 6 shows the results of an investigation conducted on the apparatus of FIG. 2 having a pair of rolls serving as lower rolls and an upper roll serving as a counter roll, for the purpose of clarifying the relationship between the amount S of tightening, i.e., the extent of lowering of the upper roll and the load acting on the upper roll, as observed when the spacing L between the lower rolls is held constant. In this apparatus, the lower rolls 32 have a diameter Dwl of 350 mm, while the upper roll 34 has a diameter Dwu of 400 mm. A white circular mark ○ shows data obtained when the spacing L of the lower rolls was set to a value, specifically 600 mm, which is smaller than 750 mm as the sum of the diameters of the upper and lower rolls as in the conventional arrangements. When such a small spacing of lower rolls is employed, high magnitudes of load are observed constantly. In contrast, the solid circular mark • indicates data obtained when the spacing L of the lower rolls was set to a value, specifically 800 mm, which is greater than 750 mm as the sum of the diameters of the upper and lower rolls. With such a large spacing of lower rolls, the magnitude of the load is generally maintained low. A further reduction in the load is achieved when the amount S of tightening, i.e., the extent of lowering of the upper roll, is increased beyond 175 mm which is the radius Rwl of the lower roll while the lower roll spacing L is maintained large.

Figure 7A:
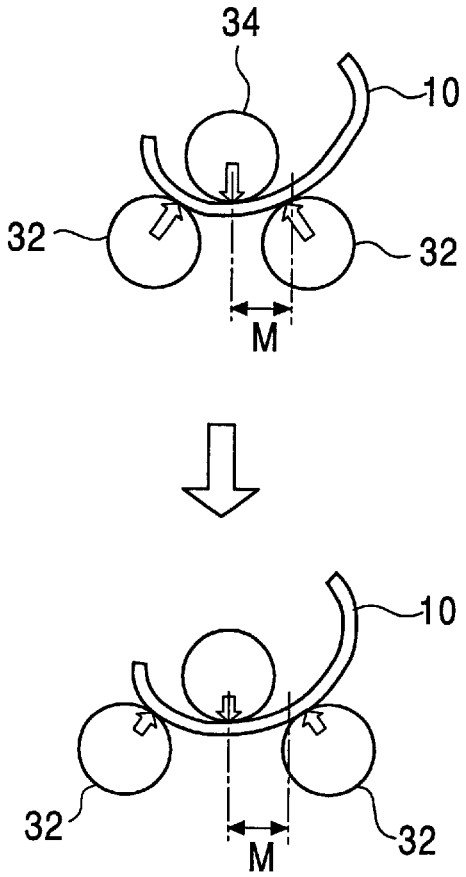
FIG. 7A is a schematic illustration of an arrangement in which the spacing of the lower rolls has been increased.

The reason why the load is reduced when the lower roll spacing l is increased will be explained with respect to FIG. 7A. Namely, when the lower roll spacing L is increased, the length of the bending moment M is correspondingly increased, so that the load on the lower rolls is reduced and, at the same time, the load on the upper roll is reduced accordingly.

Figure 7B:
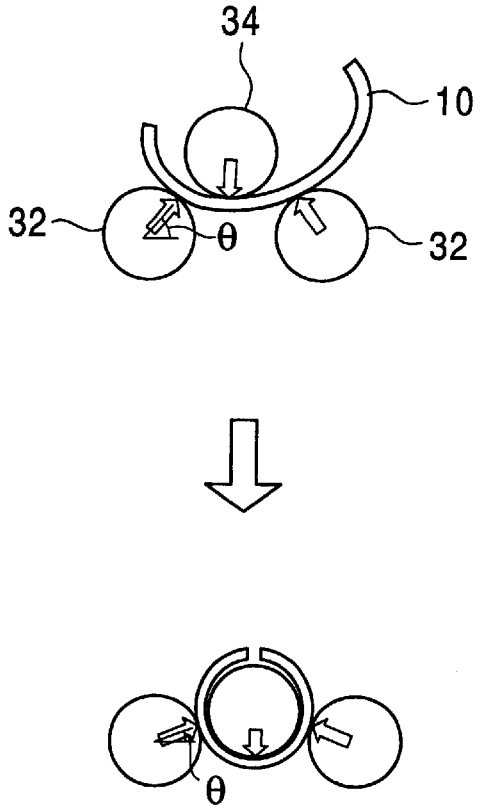
FIG. 7B is a schematic illustration of an arrangement in which an upper roll has been lowered while a large spacing is left between the lower rolls.

A description will now be given with specific reference to FIG. 7B of the reason why the load is further reduced in accordance with an increase in the amount S of tightening while the lower roll spacing L is large. Namely, in this case, the upper roll 34 is lowered further into the region between the lower rolls 32, so that the direction of the loads acting on the lower rolls 32 are changed. In other words, although the magnitude of the load acting on the lower rolls is not reduced, the angle θ of action of the load is reduced, so that the load acting on the upper roll is reduced.

The angle θ of action of the load on the lower rolls is reduced, i.e., the upper roll is caused to penetrate more deeply into the region between the lower rolls, when the following conditions (1) and (2) are met.

(1) In order that the upper roll 34 is allowed to penetrate deeper into the region between the lower rolls 32, it is necessary that the lower roll spacing L be greater than the sum of the diameter Dwu of the upper roll 34 and the diameter Dwl of each lower roll 32.

(2) Considering the situation in which the upper roll 34 falls into the region between the lower rolls 32, it is necessary that the amount S of tightening, i.e., the extent of lowering of the upper roll 34 is greater than the radius Rwl of each lower roll 32.

It is to be understood, however, that geometrical relationships exist between the amount S of tightening, i.e., the extent of lowering of the upper roll, the lower roll spacing L, and the diameter Dp of the pipe 12 which is formed in contact with the upper and lower rolls 34, 32. Therefore, when the pipe diameter Dp is determined, the values of the tightening amount S and the lower roll spacing L are interrelated: namely, it is impossible to determine the tightening amount S and the lower roll spacing L independently of each other. In other words, in order that the above-mentioned conditions (1) and (2) are simultaneously met for a variety of given pipe diameters, it is necessary that the lower roll spacing L be variable. It is, however, not essential that the lower rolls be linearly displaceable relative to one another. Any manner of change in the lower roll spacing L falls within the scope of the invention, provided that the above-described conditions (1) and (2) are simultaneously met.

The load acting on the upper roll 34 is remarkably reduced when the conditions (1) and (2) are satisfied simultaneously, so that the deflection of the upper roll 34 is significantly reduced. Therefore, the tendency of leaving an end gap is suppressed even for pipes whose diameters are so small that the backup beam and large-diameter upper rolls cannot be used. For instance, it becomes possible to produce high-strength, thick-walled elongated pipes such as 20 mm or greater in thickness, 40 kgf/mm$^2$ or higher in strength and 5 m or longer in length.

In accordance with the present invention, it is especially preferred that the apparatus is operated such that not only is the spacing between adjacent rolls in a pair always maintained greater than the sum of the diameter of the counter roll and the diameter of one of the pair of rolls, but also the roll spacing is progressively decreased as the pass progresses, so that the final amount of tightening is greater than the radius of the pair of rolls.

Further, in accordance with the present invention, it is also especially preferred that the pipe forming apparatus be operated such that the upper roll is lowered to a predetermined level in excess of the radius of the pair of rolls in earlier passes of the process, whereas, in later passes, the roll spacing is reduced.

Figure 8:
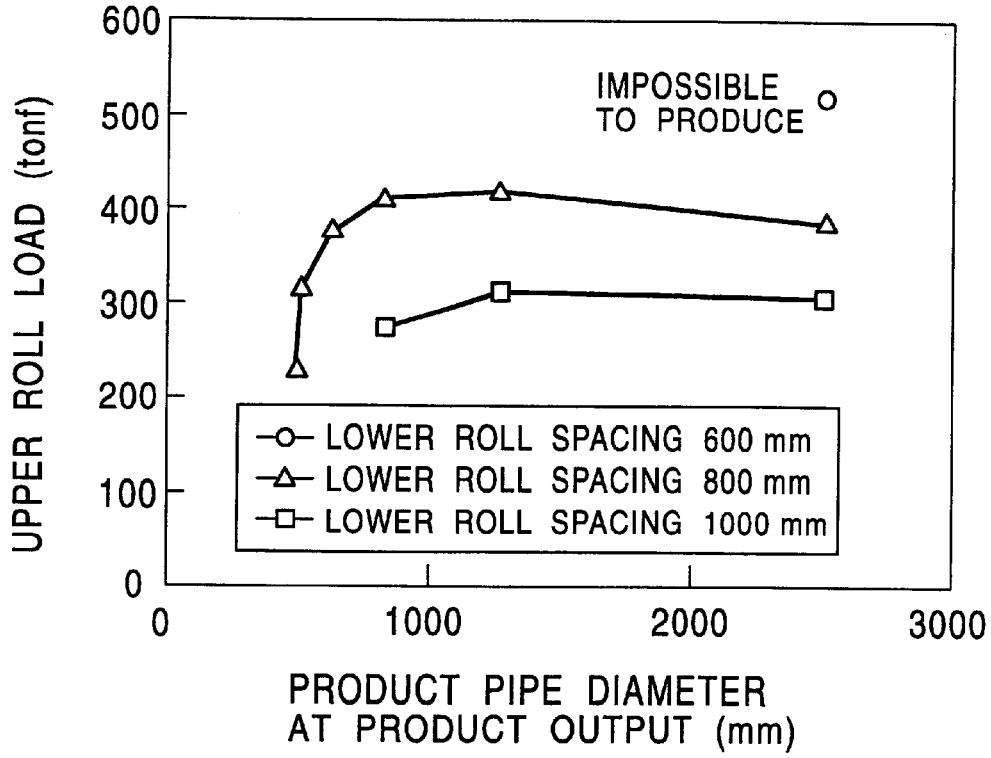
FIG. 8 is a diagram showing the relationship between the pipe diameter at the product pipe outlet and the load applied to the upper roll.

FIG. 8 shows the relationship between the pipe diameter Dp and the load in each pass, as observed when a pipe is formed by bending roll apparatus while maintaining a constant spacing between lower rolls which serve as the pair of rolls. It will be seen that, when the lower roll spacing L is small, the load acting on the upper roll serving as the counter roll is greater for pipes having smaller diameters. In particular, the data marked by ○, obtained when the lower roll spacing L is 600 mm, indicates that the production of pipe is impossible. The Δ marks indicate data obtained when the lower roll spacing L has been increased to 800 mm. In this case, the load is reduced as compared with the case where the lower roll spacing is smaller. Further, in this case, the load is drastically reduced when the pipe diameter becomes smaller as a result of an increasing number of passes. The □ marks indicate data obtained when the lower roll spacing is increased to 1000 mm. In this case, it is impossible to form the pipe to the final diameter, although the load is reduced as the number of passes increases.

In greater detail, during earlier passes in which the pipe diameter is still large, the length of the bending moment M for bending the sheet material is increased when the lower roll spacing L is increased, so that the load on the lower rolls and, hence, the load acting on the upper roll are reduced, as explained before in connection with FIG. 7A.

In contrast, in later passes in which the pipe diameter has been reduced, increase of the lower roll spacing L to a suitable value causes the upper roll 34 to fall more deeply into the region between the lower rolls 32, so that the direction in which the load acts on the lower rolls is changed to decrease the load remarkably. More specifically, although the magnitude of the load acting on the lower rolls is not decreased, the load acting on the roll is reduced owing to a reduction in the angle θ of action of the load. However, when the lower roll spacing L is increased excessively, the pipe 12 completely falls into the space between the lower rolls 32, so that the bending can no longer be effected.

The angle θ of action of the load on the lower rolls in the final stage of the process is decreased when the tightening amount S of the upper roll reaches a final value greater than the radius Rwl of the lower roll. Namely, a geometrical relationship is established such that the upper roll falls down into the region between the lower rolls, thus making it possible to control the size of the end gap. This measure alone, however, cannot eliminate the risk of deflection of the upper roll beyond the allowable limit due to heavy load that is applied in intermediate passes in which the above-described mechanism for reducing the load does not function.

However, until the number of the passes grows to such intermediate passes, the falling down of the pipe completely into the region between the lower rolls does not occur even if the lower roll spacing L is set large, because the diameter of the pipe is still large enough to prevent such falling of the pipe. It is therefore possible to maintain the load sufficiently low to avoid excessive deflection of the upper roll, by operating such that, in earlier passes in which the pipe diameter is still large, the lower roll spacing L is set large so as to reduce the magnitude of the load, whereas in later passes, the lower roll spacing L is progressively reduced as the pipe forming work proceeds towards the final pass to decrease the angle θ of action of the load on the lower rolls.

More specifically, the lower roll spacing L and the amount S of tightening in each pass may be set as follows.

As the first step, the lower roll spacing L is set to the maximum possible value. During earlier passes, the upper roll 34 is progressively lowered to increase the amount S of tightening in accordance with the increasing number of passes, while maintaining the above-mentioned maximum possible lower roll spacing L. Consequently, the pipe diameter is progressively decreased until the tightening amount S reaches the final value. This final value is greater than the lower roll radius Rwl in order that the upper roll enters the region between the lower rolls. Then, in later passes, the work is performed by progressively reducing the lower roll spacing L, while maintaining the above-mentioned final value of tightening S, thereby further decreasing the pipe diameter, thus completing the forming of the pipe.

With this pipe forming method, it is possible to always maintain the load at sufficiently low magnitudes, by a combined load reducing effect offered by the large lower roll spacing L in earlier passes and the reduction in the angle θ of action of the load offered in later passes of the pipe forming work.

Thus, pipes can be formed without causing the load on the upper roll to exceed the maximum allowable value, while preventing creation of end gap, even when the pipe diameter is so small as to preclude the use of a backup beam or a large-diameter upper roll. It is thus possible to produce high-strength, thick-walled elongated pipes.

Second Aspect of the Invention

As explained before in connection with FIG. 8 which shows the relationship between the pipe diameter Dp and the load in each pass, the production of a pipe is impossible when the lower roll spacing L is 600 mm, as indicated by the mark ○. When the lower roll spacing L is increased to 800 mm, the load is reduced as compared with the case where the lower roll spacing L is smaller, as indicated by the mark Δ. A further increase of the lower roll spacing L to 1000 mm makes it impossible to work the pipe to the final diameter, although the magnitudes of load in intermediate passes are lowered, as indicated by the mark □.

Figure 9A:
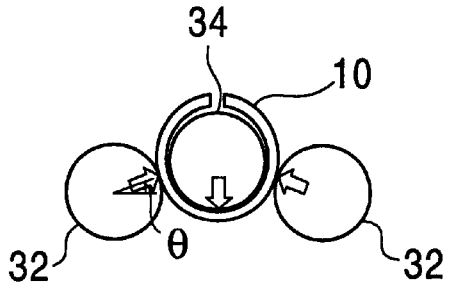
FIG. 9A is a schematic illustration of an arrangement in which an upper roll has been lowered while a large spacing is left between lower rolls.
Figure 9B:
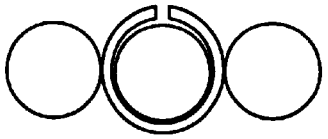
FIG. 9B is a schematic illustration of a product which is obtained when an excessively large spacing is left between the lower rolls.

FIGS. 9A and 9B show the roll arrangement for a given final pipe diameter. As will be seen from FIG. 9A, when the lower roll spacing L is increased to a suitable value, the upper roll 34 is allowed to fall into the region between the lower rolls 32, with the result that the direction of the load on the lower rolls is changed to remarkably reduce the load. More specifically, the angle θ of action of the load is decreased although the magnitude of the load acting on the lower rolls 32 is not changed, so that the magnitude of the load acting on the upper roll is reduced. When the lower roll spacing L is increased excessively, the pipe 12 completely falls into the region between the lower rolls 32, thus making it impossible to effect further work for forming the pipe.

In other words, it is possible to significantly reduce the load, on condition that the lower roll spacing L is set to a value which is large but does not exceed a value that allows the pipe to fully fall into the region between the rolls. The size of the end gap depends on the final forming condition. It suffices that the above-mentioned condition concerning the lower roll spacing be met in the final stage. Representing the product pipe diameter by Dp and the lower roll diameter by Dwl, while representing the lower roll spacing L, the geometrical threshold condition for preventing the pipe from fully falling down into the region between the lower rolls is given by the following expression.

$$L=(Dp+Dwl) \tag{2}$$

Figure 10:
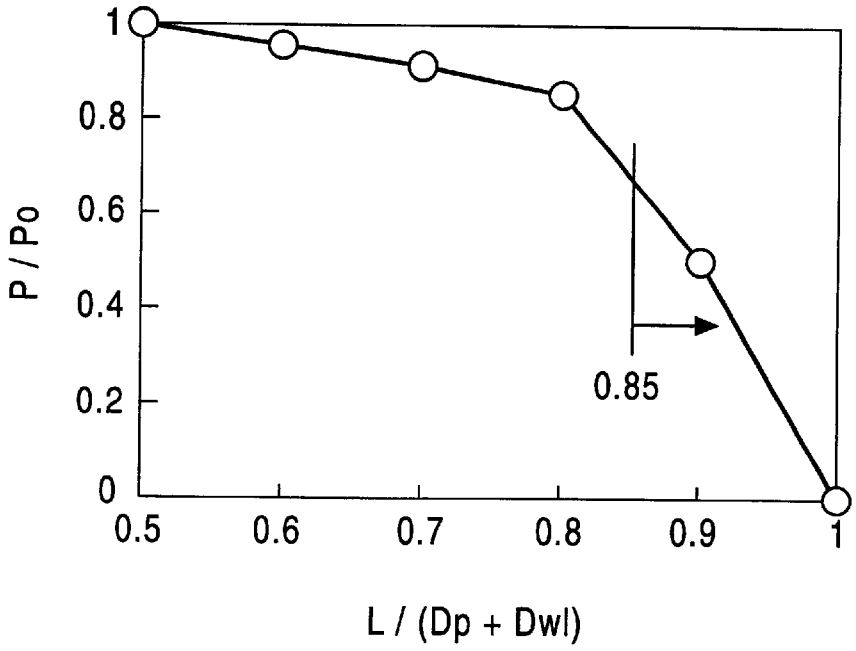
FIG. 10 is a diagram showing the relationship between L=(Dp+Dwl) and a load ratio P/P0.

It is therefore understood that the lower roll spacing L has to be smaller than the sum (Dp+Dwl) of the product pipe outside diameter Dp and the lower roll diameter Dwl, in order to avoid completely falling of the pipe into the space between the lower rolls. However, the lower limit of the lower roll spacing L is still a question. An investigation was therefore made to find the relationship between the ratio L/(Dp+Dwl) of the lower roll spacing L to the sum (Dp+Dwl) of the product pipe outside diameter Dp and the lower roll diameter Dwl and the load ($P/P_0$), the result of which is shown in FIG. 10. The symbol $P_0$ represents the magnitude of the load as obtained when the lower roll spacing L is set to L=0.5(Dp+Dwl). As will be seen from this Figure, the load drastically decreases when the ratio L/(Dp+Dwl) exceeds 0.85 and is reduced to zero when the ratio L/(Dp+Dwl) reaches 1.0. This shows the threshold condition. It is thus understood that the range specified by the foregoing expression (1) is the effective range.

Therefore, the load can be maintained sufficiently low, when the pipe forming work is executed by progressively increasing the amount S of tightening while setting the lower roll spacing L to fall within the range specified by the expression (1). Consequently, it is possible to form a high-strength, thick-walled elongated pipe with reduced end gap, even when the pipe diameter is so small as to exclude the use of a backup beam or a large-diameter upper roll.

In order that the lower roll spacing is set to fall within the range specified by the expression (1), it is advantageous that the lower roll spacing l is linearly variable. This, however, is not essential and the change in the lower roll spacing may be effected in a stepped manner over several stages by changing the roll combination. It is also to be understood that the pipe forming apparatus of the present invention may employ lower rolls that are set at a fixed spacing L. In other words, the condition of the expression (1) is met for pipes of certain ranges of pipe diameter, and the production of such pipes while satisfying the condition of the expression (1) falls within the scope of the present invention.

In accordance with the present invention, the aforesaid problem or shortcoming is overcome by working a material while setting the ratio of change of the curvature to a value not greater than 10% of the final curvature and setting the roll spacing to fall within the range specified by the aforesaid expression (1).

This forming method may be applied to the final pass in the roll bending, when no bend correcting work is executed.

Alternatively, when bend correction is effected prior to the tack welding, the bend correcting work may be executed in accordance with the method described above.

Another alternative is that, when the bend correcting work is executed subsequent to the tack welding, the above-described method is applied both to the final pass of the roll bending and the bend correcting work.

Figure 11:
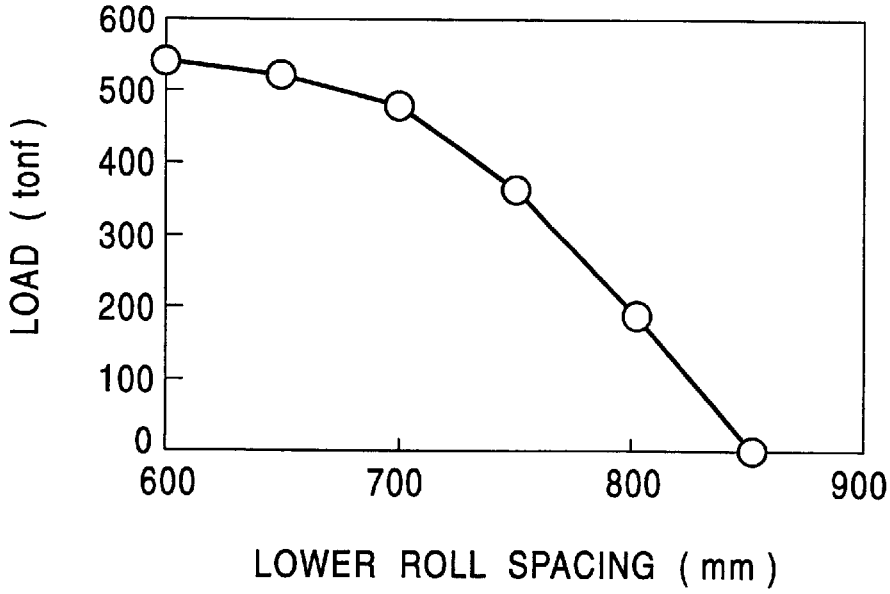
FIG. 11 is a diagram showing the relationship between the spacing of lower rolls and the load.

FIG. 11 shows the results of a bend correcting work executed on a pipe blank of 500 mm diameter and having an end gap of about 50 mm, in which roll bending was effected after changing again the spacing L of the lower rolls as the pair of rolls for the purpose of correcting the curvature to achiever higher circularity. It will be seen that the load is reduced in two stages in accordance with the increase in the lower roll spacing. As a result, the size of the end gap also is changed drastically. The lower limit of the lower roll spacing is drawn at a point where the load is reduced to zero, which corresponds to the pipe passing completely through the space between the lower rolls, as explained before in connection with FIG. 9B. It is therefore understood that the lower roll spacing L falling within the range specified by the expression (1) is effective. More specifically, it is possible to maintain the load sufficiently low, when the pipe forming work is executed by progressively increasing the tightening amount of the upper roll while maintaining the lower roll spacing L within the range specified by the expression (1). This indicates that the size of the end gap is determined solely by the final pass, regardless of the intermediate passes.

Figure 12:
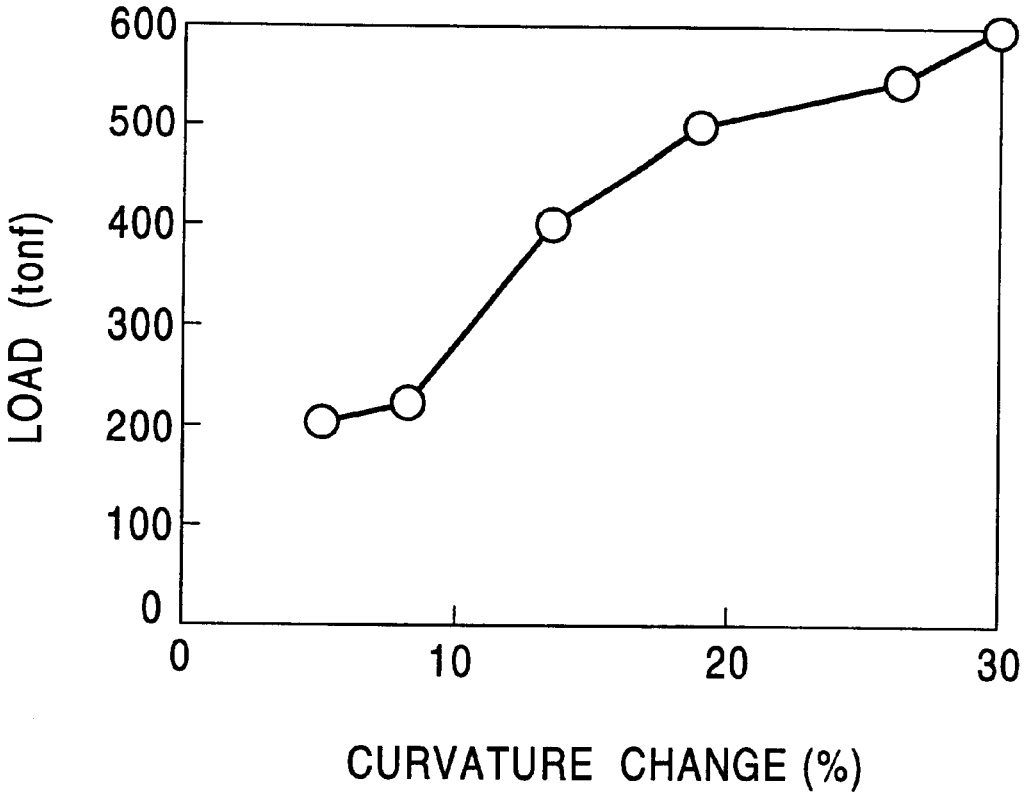
FIG. 12 is a diagram showing the relationship between the ratio of change in the curvature at the final pass and the load.

The above-described results, however, are obtained when a pipe blank that has already been formed into the shape of a pipe is again worked for correction of curvature. An experiment was therefore executed in which the magnitude of the load and the size of the end gap were examined with various curvatures in the final pass while setting the lower roll spacing of the final pass to fall within the above-described range. The results of the experiment are shown in FIG. 12. It will be seen from FIG. 12 that the load drastically drops when the bending curvature is not greater than 10% of the pipe curvature. It is therefore understood that the final pass should be executed to effect a bending as small as that for a bend correcting pass. As described above, a pipe blank which has already been shaped into the form of a pipe may be subjected again to roll bending which is executed with the lower roll spacing described above. In such a case, the work process down to the completion of the blank pipe corresponds to intermediate passes in the pipe forming method of the invention, and the roll bending effected on the shaped pipe blank corresponds to the final pass of the pipe forming method of the invention. The use of the specified lower roll spacing during the roll bending on the completed pipe blank, therefore, falls within the scope of the present invention.

When the above-described conditions are satisfied, the load applied to the upper roll can be greatly reduced, so that the deflection of the upper roll is suppressed correspondingly. This serves to suppress creation of the end gap even for pipes having diameters which are so small as to prevent the use of a backup beam or a large-diameter upper roll. It is thus possible to produce high-strength, thick-walled elongated pipes of small diameters.

Third Aspect of the Invention

Figure 13:
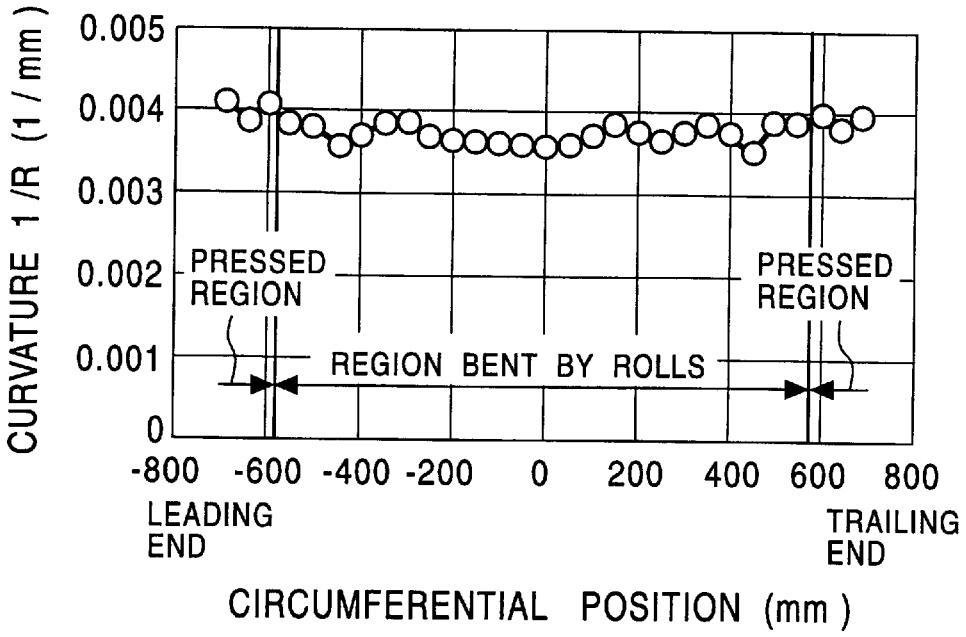
FIG. 13 is a diagram showing the results of an investigation conducted to find the variation in the severity of end gaps created at a longitudinal central portions of product pipes along curvatures.

The inventors have made an investigation to find curvature distribution of the end gap created in the longitudinally central region of the pipe. As will be understood from FIG. 13 which shows the results of the investigation, the leading and trailing end regions of the pipe that are not worked by the bending rolls, i.e., that are bent in advance of the process by means of a press or the like, are finished to have a curvature of 0.004 which corresponds to the diameter of the product pipe, whereas the intermediate portions that have been bent by means of the bending rolls have smaller curvatures. This indicates that the creation of the end gap is attributable to insufficient roll bending of the intermediate portions.

Figure 14:
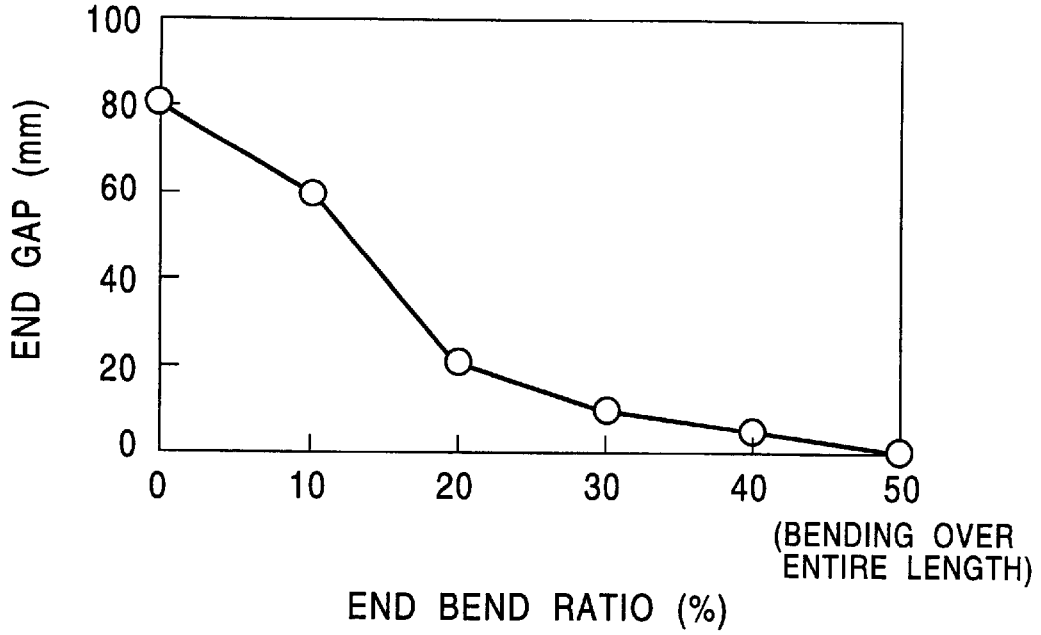
FIG. 14 is a diagram showing the results of the same investigation as that in FIG. 13, as obtained when the ratio of the end bend has been changed.

FIG. 14 shows the results of an investigation in which the ratio of the end regions bent in advance by other techniques, e.g., by a press, than the bending rolls was varied to investigate how the size of the end gap varies in accordance with the ratio of the size of the end regions to the overall circumference of the pipe. The right-hand side of the diagram of FIG. 14, indicated by a value 50%, means that the circumferential length of each of the leading and trailing end regions bent in advance by, for example, a press, reaches 50% of the entire circumference of the pipe, i.e., the entirety of the pipe has been finished by bending in advance the end bending method employing, for example, the press. Obviously, almost no end gap is formed in this state. This state, however, is an extreme one and a significant decrease in the size of the end gap is achieved when the circumferential length of each end region bent in advance of the roll bending is 20%, i.e., one fifth, of the entire circumference of the pipe. This owes to the fact that the tendency for the roll bending to become insufficient is suppressed by the effect produced by the rigidity of the end regions which have been bent in advance of the bending by the bending rolls.

In order that the end bent region is enlarged to reach ⅕ the entire circumference of the pipe, it is necessary that each of the leading and trailing end regions of the sheet material be bent over a length which is at least ⅕ the entire circumference of the pipe. Such an end bending may be effected by a press as described above, or by rolls or other devices which can produce an effect to decrease the amount of the end gap to a level smaller than that produced by the bending rolls.

Furthermore, it is necessary that the circumferential length of the regions to be bent by the bending rolls be restricted to be less than ⅗ the entire circumference of the pipe, in order that the end bent regions are not deformed or reduced in the course of the subsequent bending by the bending rolls. In order to avoid the undesirable deformation of the end bent regions, the operation of the bending rolls may be suspended to prevent the bent end regions from being affected by the bending rolls.

Figure 15:
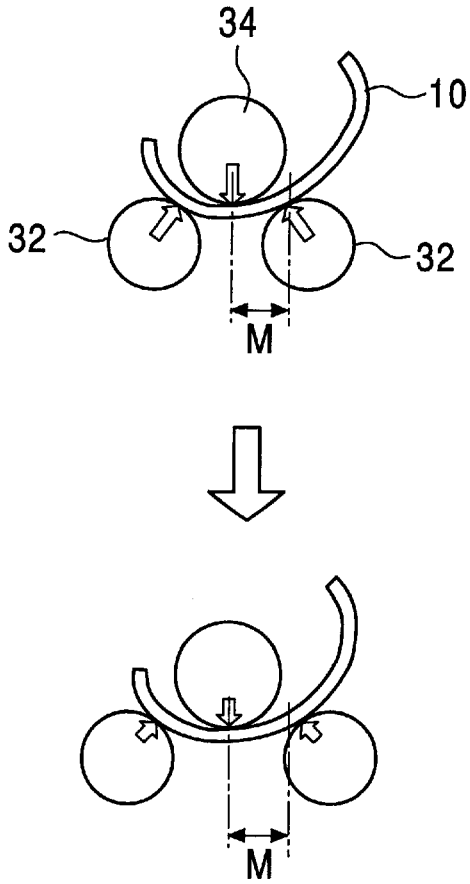
FIG. 15 is a schematic illustration of an arrangement having an increased lower roll spacing, explaining a principle of the present invention.

An increase in the spacing L of the lower rolls serving as the pair of rolls (see FIG. 2) not only increases the circumferential length of the zone in each bent end region not affected by the bending rolls but also serves to reduce the deflection of the rolls. More specifically, an increase in the lower roll spacing L naturally increases the distance between each lower roll 32 and the upper roll 34 serving as the counter roll, so that the circumferential length of the zone not affected by the bending rolls is increased. Further, as will be seen from FIG. 15, the increase in the distance between the upper roll 34 and the lower roll 32 leads to an increase in the length of arm of the bending moment M, so that the load is reduced correspondingly to suppress the bending of the rolls. Thus, when the circumferential length of the region to be bent by the rolls is set below ⅗ of the entire circumference of the pipe while the lower roll spacing L is increased, a greater effect of suppressing creation of end gap is achieved because the bending by the rolls themselves contributes to prevent formation of the end gap, by virtue of the reduced deflection of the rolls. It is also possible to simultaneously use both the suspension of the bending roll operation and the increase of the lower roll spacing L, when setting the circumferential length of the region to be bent by the rolls to less than ⅗ the entire circumference of the pipe.

According to this aspect of the present invention, it is possible to produce high-strength, thick-walled elongated pipes, even when the pipe diameters are so small as to prevent the use of a backup beam or a large-diameter upper roll.

It will be clear to those skilled in the art that the pipe forming method in accordance with the first to third aspects can be used not only for small-diameter pipes but also for production of large-diameter pipes. The pipe forming method of the present invention, when used in the production of large-diameter pipes, eliminates the necessity for any backup beam and alteration of the upper roll, thus contributing to simplification of the production equipment and also to improvement in the efficiency of the pipe forming work.

A symmetrical pyramidal three-roll-type roll bender, having a pair of power-driven lower rolls and one tightening upper roll, has been specifically mentioned in the foregoing description. The use of this type of roll bender, however, is not essential. For instance, the pipe forming method in accordance with the present invention may also be applied to a variety of types of roll benders, such as an asymmetrical roll bender in which the upper roll is offset, a roll bender including more than 3 lower rolls, e.g., a four-roll type roll bender that has an additional lower roll arranged at a position spaced apart from the lower rolls 32 shown in FIG. 2, a pyramidal roll bender which is implemented by turning upside down the roll arrangement of FIG. 2, and a roll bender in which the pair of rolls and the counter roll are arranged laterally along the sheet material rather than opposing each other across the sheet material.

It is also to be noted that the pair of rolls may have different diameters, in which case for example the parameter Dwl used in the above expressions would be the sum of their radii Rwl1 and Rwl2.

The embodiment of each aspect of the invention will now be illustrated through Examples.

First Aspect

Figure 16:
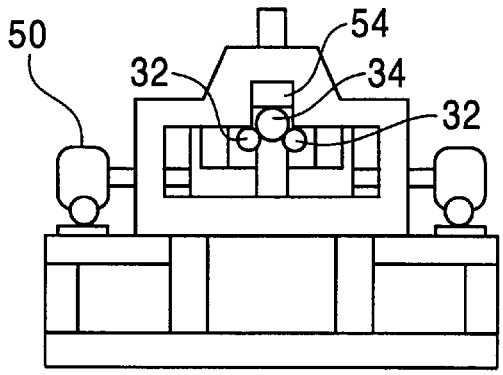
FIG. 16 is a front elevational view of an embodiment of the pipe forming apparatus in accordance with the present invention.
Figure 17:
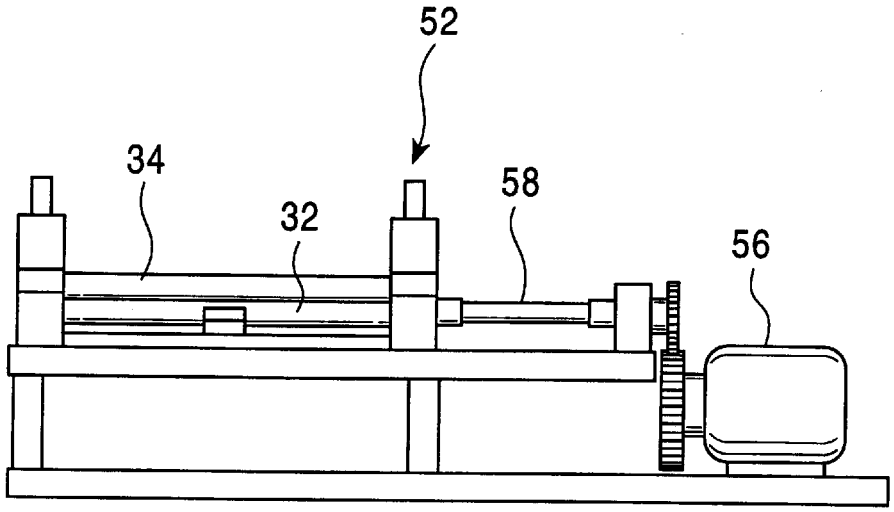
FIG. 17 is a side view of the pipe forming apparatus shown in FIG. 16.

FIGS. 16 and 17 are a front elevational view and a side elevational view of a pipe forming apparatus embodying the present invention. The apparatus has a pair of lower rolls 32 and an upper roll 34 disposed above the lower rolls 32 at a position intermediate between the lower rolls. The pipe forming apparatus further has a driving motor 50 for setting the lower roll spacing. The driving motor 50 is capable of setting the spacing L of the lower rolls 32 to a value greater than the sum of the diameter Dwu of the upper roll 34 and the diameter Dwl of the lower roll 32. The pipe forming apparatus also has a hydraulic drafting device 52 which can set the amount S of tightening of the upper roll 34 with respect to the lower roll 32 to a value which is greater than the radius Rwl of the lower roll 32. In these Figures, numeral 54 denotes a load cell for sensing the magnitude of the load acting on the upper roll 34, while 56 designates a lower-roll driving motor which drives the lower rolls 32 through a spindle 58.

Figure 18:
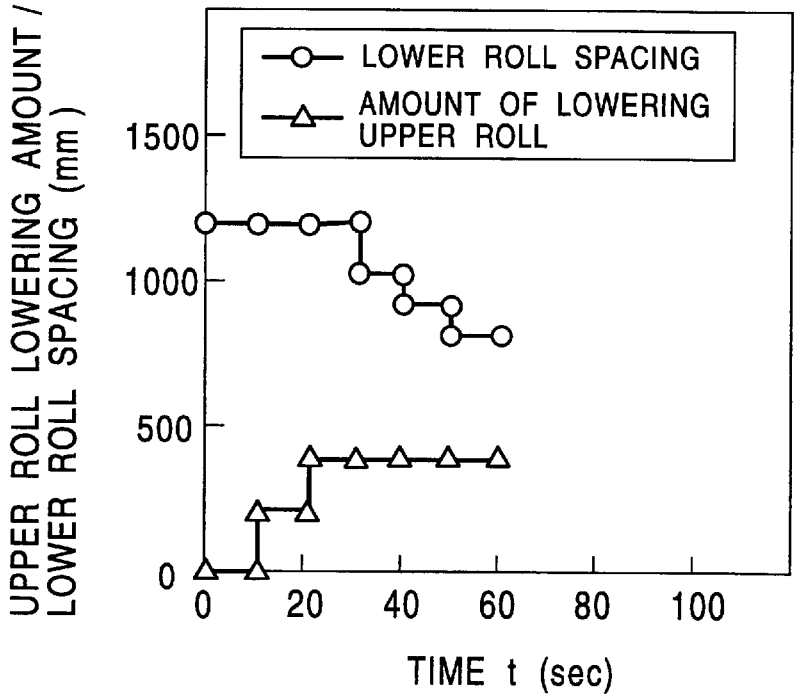
FIG. 18 is a diagram showing an example of a procedure for changing the extent of lowering the upper roll and the spacing of lower rolls in the pipe forming apparatus embodying the present invention.
Figure 19:
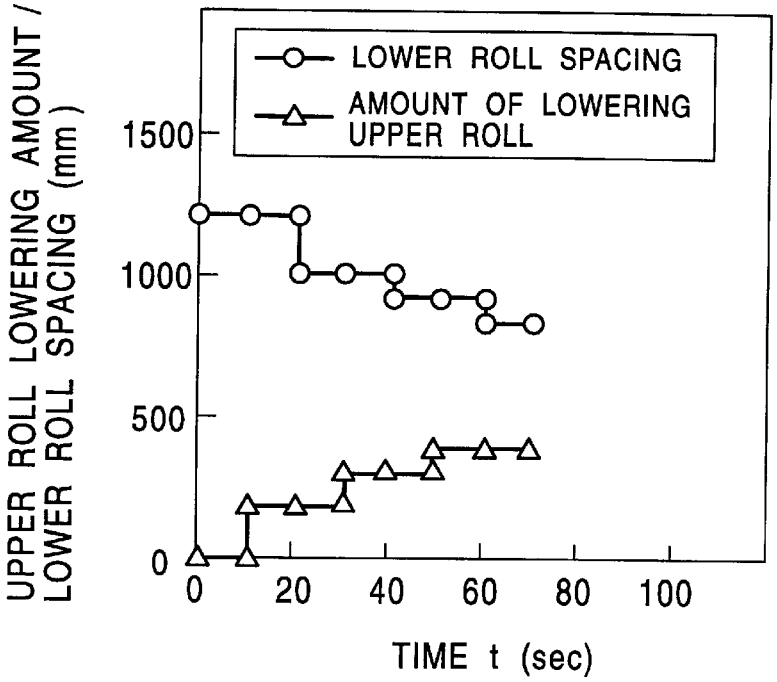
FIG. 19 is a diagram showing another example of the procedure.
Figure 20:
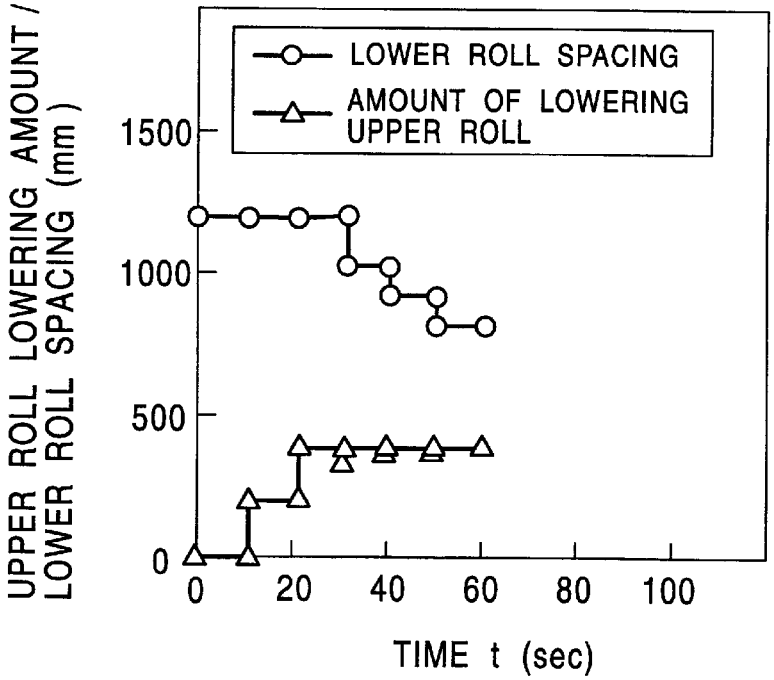
FIG. 20 is a diagram showing still another example of the procedure.

FIGS. 18 to 20 show the relationships between the amount of tightening of the upper roll and the lower roll spacing, as observed when the tightening amount and roll spacing are varied in accordance with the progress of the passes in accordance with the invention. More specifically, FIG. 18 shows the relationship as observed when the tightening by the upper roll is effected in earlier passes, while the lower roll spacing was varied in later passes. FIG. 19 shows the relationship as observed when the tightening by the upper roll and the change of the lower roll spacing were executed alternately. FIG. 20 shows the relationship as observed when the operation was executed in accordance with the schedule shown in FIG. 11, in which the working condition was changed in a stepped manner by releasing the upper roll, altering the lower roll spacing and then resetting the upper roll to the original position.

Embodiment 1

Figure 3:
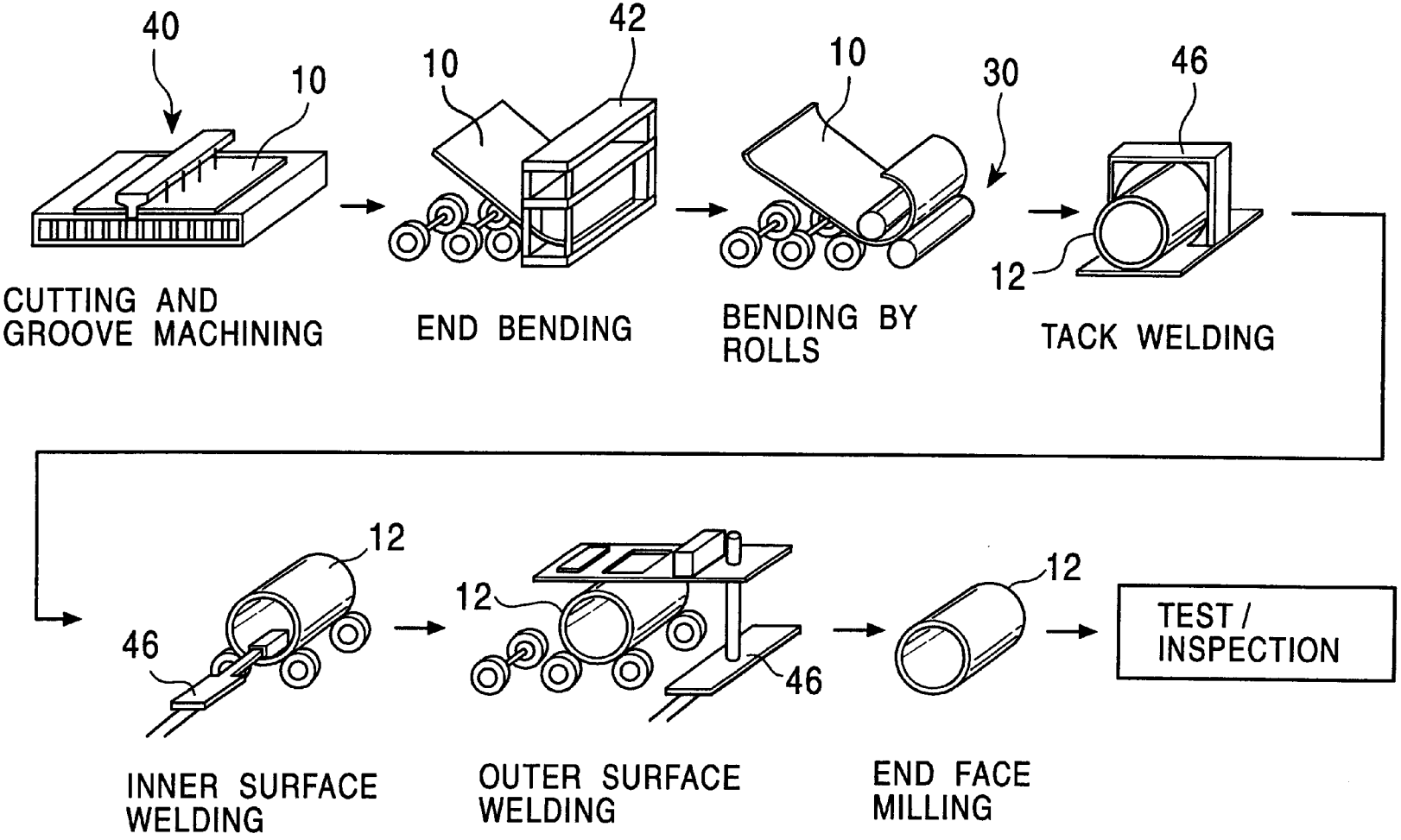
FIG. 3 is a perspective view of an arrangement for producing a steel pipe with a roll bender.
Figure 4:
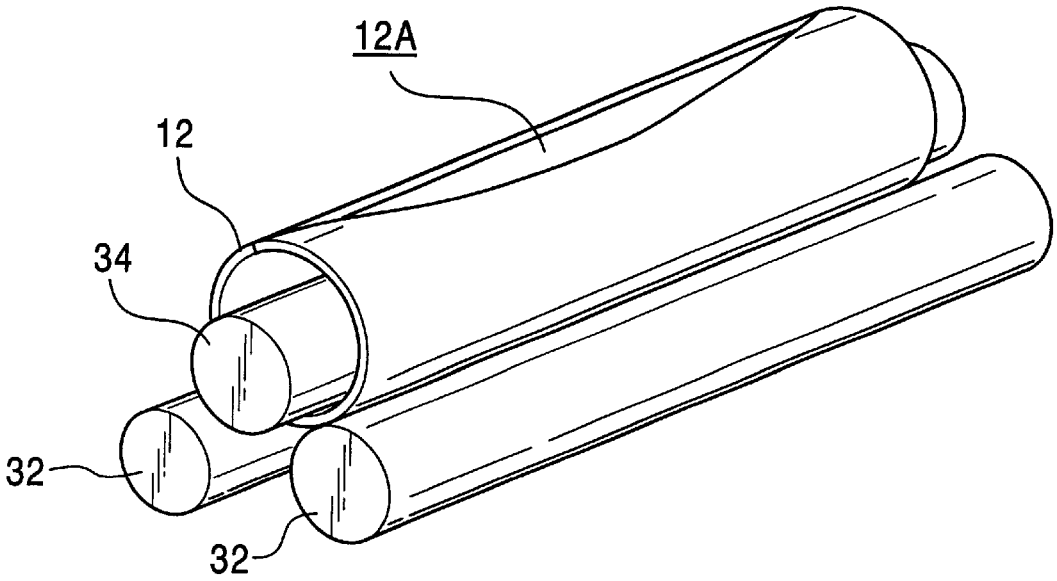
FIG. 4 is a perspective view of a pipe produced by a known roll bender, showing particularly an end gap left in the pipe.
Figure 5:
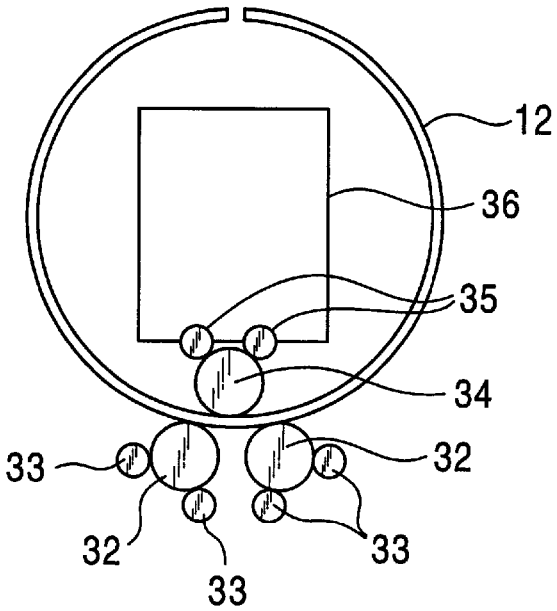
FIG. 5 is a front elevational view of an arrangement which carries out a method proposed in Japanese Kokai No. 53-128562.

A high-tension steel sheet 30 mm thick and 6000 mm wide was cut into blank sheets of a length corresponding to the diameter of a pipe to be produced. The leading and trailing end regions of the blank sheets were pre-formed into arcuate form by a hydraulic press 42 of the type shown in FIG. 3. The thus-pre-worked steel sheets were then subjected to bending with a roll bender 30 in accordance with the present invention, so as to be formed into pipes of 500 mm diameter and 700 mm diameter. The diameter Dwu of the upper roll and the diameter Dwl of the lower rolls were 400 mm and 350 mm, respectively.

The pipe forming work using the roll bender 30 was executed in each of the following three conditions (1) to (3)

(1) Comparative Example 1

The lower roll spacing L was set to 600 mm.

(2) Comparative Example 2

The lower roll spacing was set to 800 mm, while the amount S of tightening was less than 160 mm.

(3) Inventive Example 1

Figure 21:
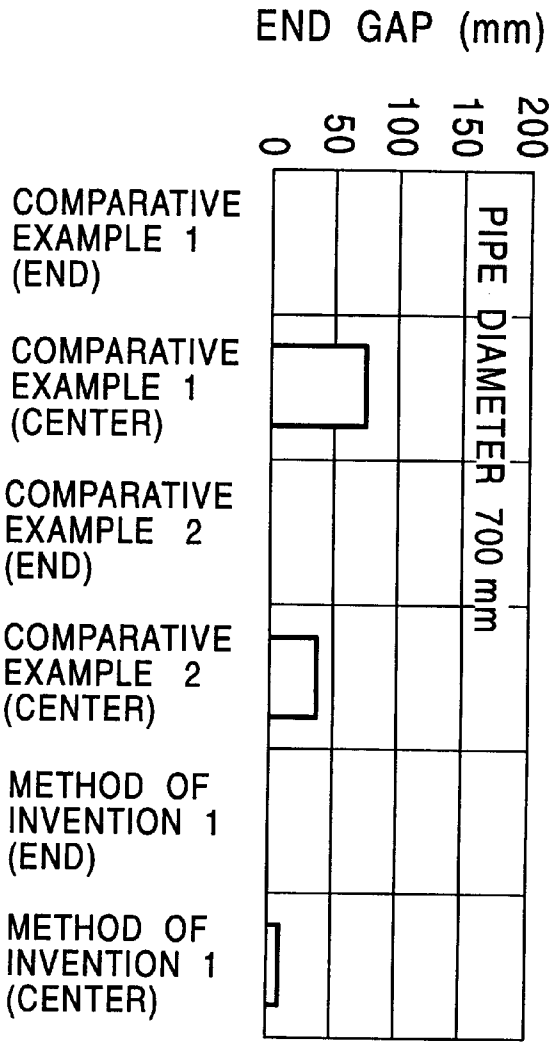
FIG. 21 is a diagram showing the amounts of end gaps of pipes having a pipe diameter of 700 mm produced in accordance with the method of the invention, in comparison with those of pipes produced in accordance with Comparison Examples.
Figure 22:
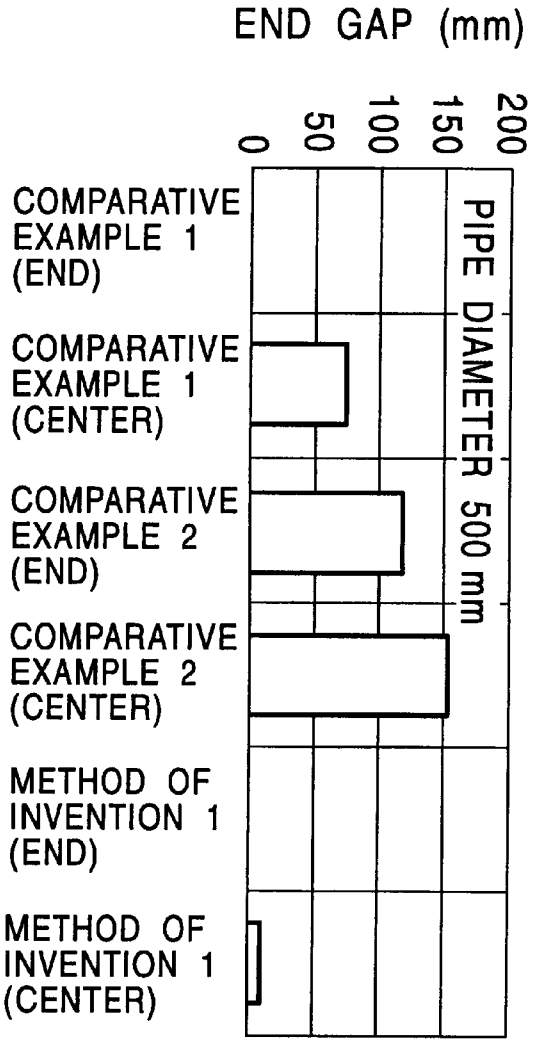
FIG. 22 is a diagram showing the amounts of end gaps of pipes having a pipe diameter of 500 mm produced in accordance with the method of the invention, in comparison with those of pipes produced in accordance with Comparison Examples.

Pipe forming work was conducted by employing tightening amounts S not smaller than 180 mm, while the lower roll spacing L was varied within the range of from 800 to 1200 mm. The sizes of the end gaps observed after the pipe forming work under these three different conditions are shown in FIG. 21 for the pipes of 700 mm diameter and in FIG. 22 for the pipes of 500 mm diameter.

In Comparative Example 1, a large difference of 80 mm was observed between the end gap at the longitudinally central portion of the pipe and the end gap at both longitudinal ends of the pipe, due to excessive load applied during the pipe forming work, in each of the pipes of 700 mm diameter and 500 mm diameter. Pipes having such large end gaps are not acceptable as commercial products.

In Comparative Example 2, the pipe of 700 mm diameter showed a reduced difference of 40 mm between the end gap at the longitudinal center and the longitudinal end of the pipe, owing to the reduction in the load magnitude offered by the spacing L between the lower rolls being greater than that in Comparative Example 1. The pipe thus formed, however, is still unsatisfactory due to inferior final pipe configuration. In case of the pipe of 500 mm diameter, a large end gap in excess of 100 mm was formed both at the longitudinal center and end portions of the pipe and, therefore, this pipe was completely useless as a commercial product. This is attributable to an insufficient tightening amount S of 160 mm.

Referring now to Inventive Example 1, sufficiently large amounts S of tightening were afforded by virtue of appropriate setting of the lower roll spacing L, so that the pipe forming work could be conducted under remarkably reduced load both for the pipes of 500 mm diameter and 700 mm diameter. Consequently, the sizes of the end gaps at the longitudinal centers of the pipes were as small as under 10 mm, so that pipes having configurations acceptable as commercial products could be obtained.

Then, a high-tension steel sheet 40 mm thick and 6000 mm wide was cut into blank sheets of a length corresponding to the diameter of a pipe to be produced. The leading and trailing end regions of the blank sheets were pre-formed into arcuate form by a press. The thus-pre-worked steel sheets were then subjected to bending conducted under three different conditions (1) to (3) shown below with a roll bender, so as to be formed into pipes of 500 mm diameter. The diameter Dwu of the upper roll and the diameter Dwl of the lower rolls were 400 mm and 350 mm, respectively.

(1) Comparative Example 3

The lower roll spacing L was set to 600 mm.

(2) Comparative Example 4

The lower roll spacing was set to 1000 mm.

(3) Inventive Example 2

Pipe forming work was conducted by employing tightening amounts S not less than 180 mm, while the lower roll spacing L was initially set to 1000 mm and then progressively decreased.

Figure 23:
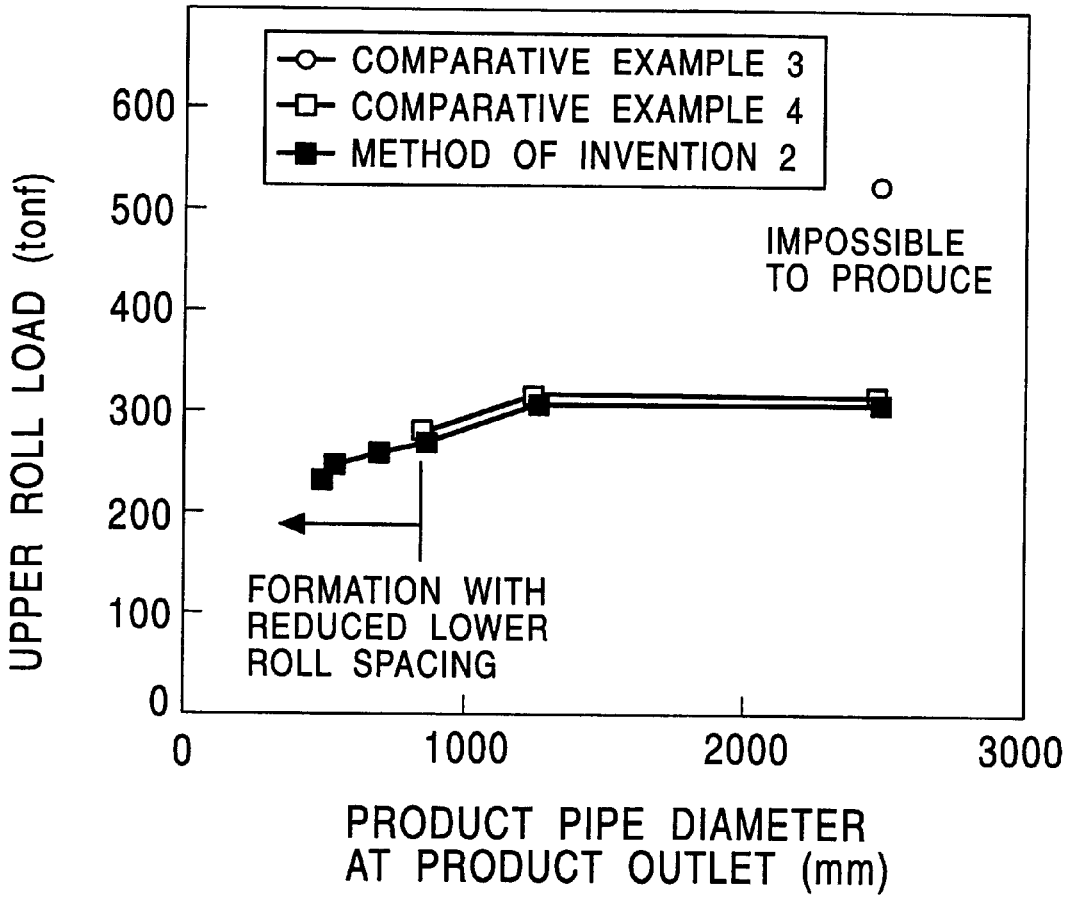
FIG. 23 is a diagram showing the relationship between the pipe diameter at the product pipe outlet and the load acting on the-upper roll.
Figure 24:
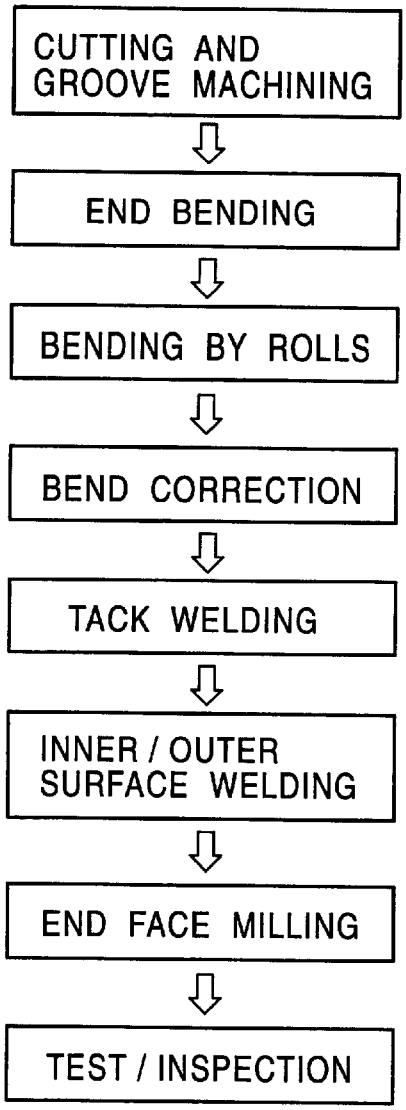
FIG. 24 is a chart showing another example of a process for producing a steel pipe by using a roll bender.
Figure 25:
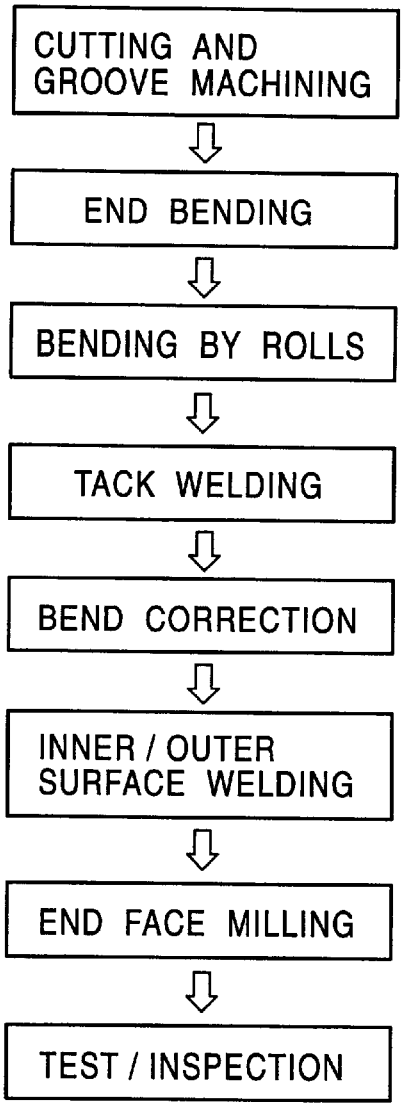
FIG. 25 is a chart showing still another example of the steel pipe production process.

Load magnitudes for the respective passes are shown in FIG. 23.

In Comparative Example 3, as shown by a mark ○, the first pass could not provide a desired amount of bend, so that subsequent passes could not be executed and the pipe production failed. In Comparative Example 4, as shown by a mark □, the desired amount of bend could be obtained in each pass, by virtue of the reduction in the load offered by the lower roll spacing L being greater than that in Comparative Example 3. However, when the lower roll spacing is not greater than 850 mm, pipe formation could not be executed because the pipe passed completely through the space between the lower rolls. In contrast, in Example 2 of the invention, as indicated by a mark ■, the desired amount of bend could be achieved in each of the earlier passes, because the load magnitude was sufficiently low as in Comparative Example 4. In later passes, the pipe did not fully drop into the space between the lower rolls, because the lower roll spacing L was reduced, so that the pipe forming work could be continued down to the final diameter while maintaining the load magnitude sufficiently low. Since the pipe forming work could be completed under small load, the size of the end gap at the longitudinal center of the pipe was less than 10 mm, whereby a pipe having configuration acceptable as a commercial product could be obtained.

In the foregoing description, steel pipes are specifically mentioned as the pipes to which the invention is applied. This, however, is only illustrative and the invention may be applied equally well to the production of pipes of materials other than steel, e.g., copper, aluminum, titanium, brass and so forth.

The mentioned hydraulic drafting device and driving motor also are illustrative, and various other actuators may be used for the purpose of tightening the upper roll and for changing the lower roll spacing. Further, although the lower rolls are power-driven while the upper roll is used as a tightening roll, this is not exclusive and other arrangements that produce an equivalent effect can also be adopted.

According to the present invention, it is possible to suppress the deflection of the counter roll by reducing the magnitude of the load applied to the upper roll during the bending work performed by the roll bender. Consequently, the bending work is performed without causing the deflection of the upper roll to exceed the allowable limit, so that creation of the end gap at the longitudinally central region of the pipe is sufficiently suppressed. It is therefore possible to produce high-strength, thick-walled elongated pipes having excellent pipe configuration and a high degree of dimensional precision.

Second Aspect

Embodiment 2

A high-tension steel sheet 30 mm thick and 6000 mm wide was cut into blank sheets of a length corresponding to the diameter of a pipe to be produced. The leading and trailing end regions of the blank sheets were pre-formed into arcuate form by a hydraulic press 42 of the type shown in FIG. 3. The thus-pre-worked steel sheets were then subjected to bending with a roll bender 30, so as to be formed into pipes of 500 mm, in accordance with the following two conditions (1) and (2). The diameter Dwu of the upper roll and the diameter Dwl of the lower rolls were 400 mm and 350 mm, respectively.

(1) Comparative Example 1

The lower roll spacing L was set to 600 mm.

(2) Inventive Example 1

Figure 26:
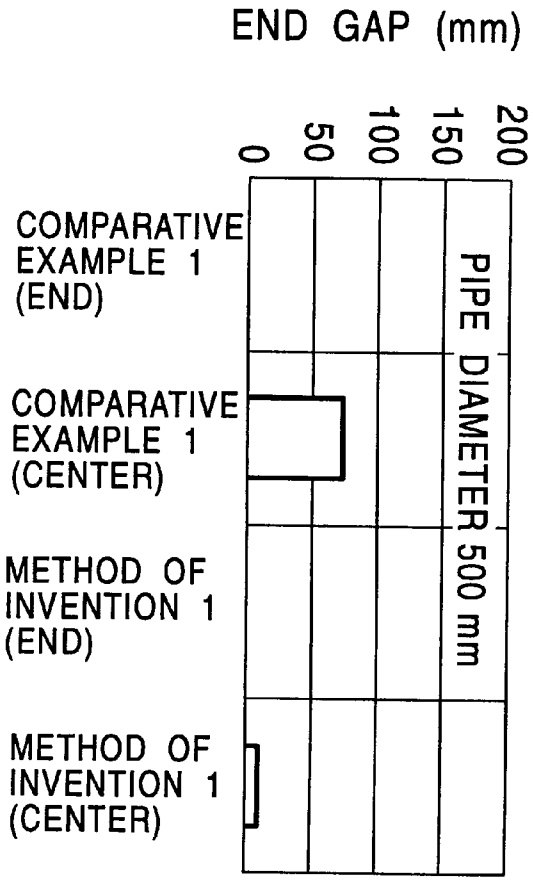
FIG. 26 is a diagram showing the amounts of end gaps of pipes having a pipe diameter of 500 mm produced in accordance with Examples of the method of the invention, in comparison with those of pipes produced in accordance with Comparison Examples.

All the passes were executed while setting the lower roll spacing L to 800 mm. The amounts of end gaps obtained under these two different conditions are shown in FIG. 26.

In Comparative Example 1, the difference in the size of the end gap between the longitudinally central region and end regions was as large as 80 mm and, hence, the pipe was unacceptable as a commercial product. This is attributable to a too large load applied in the course of the bending. In contrast, in Inventive Example 1, the magnitude of the load could be significantly reduced by virtue of the large amount S of tightening. Consequently, the pipe had only a small end gap of 10 mm at the longitudinal center. It was thus possible to obtain a product pipe having excellent pipe configuration.

Then, a high-tension steel sheet 30 mm thick and 6000 mm wide was cut into blank sheets of a length corresponding to the diameter of a pipe to be produced. The leading and trailing end regions of the blank sheets were pre-formed into arcuate form by a press. The thus-pre-worked steel sheets were then subjected to bending with a roll bender, so as to be formed into pipes of 500 mm, under the following three conditions (1) to (3). The diameter Dwu of the upper roll and the diameter Dwl of the lower rolls were 400 mm and 350 mm, respectively.

(1) Comparative Example 2

All the passes were executed while the lower roll spacing L was set to 600 mm.

(2) Inventive Example 2

The final pass was executed to effect a curvature change of $3\times10^{-4}$ (this amounts to reduction of diameter from 540 mm to 500 mm) while setting the lower roll spacing L to 800 mm.

(3) Inventive Example 3

A pipe which was formed in accordance with Comparative Example 1 was again subjected to bending executed with the lower roll spacing L set to L=800 mm.

Figure 27:
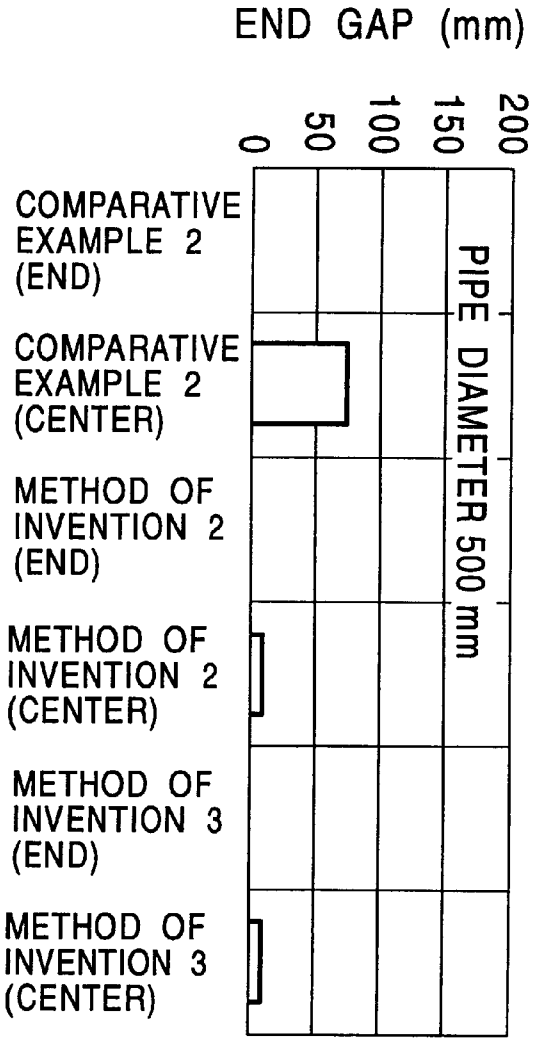
FIG. 27 is a diagram showing the amounts of end gaps of pipes having a pipe diameter of 500 mm produced in accordance with Examples of the method of the invention, in comparison with those of pipes produced in accordance with Comparison Examples.

The amounts of the end gaps in the pipes produced under these conditions are shown in FIG. 27 for comparison.

In Comparative Example 2, the difference in the size of the end gap between the longitudinally central region and end regions was as large as 80 mm and, hence, the pipe was unacceptable as a commercial product. This is attributable to a too large load applied in the course of the bending. In contrast, in each of Inventive Examples 2 and 3, the magnitude of the load could be significantly reduced by virtue of the large amount S of tightening. Consequently, the pipe had only a small end gap of 10 mm at the longitudinal center. It was thus possible to obtain a product pipe having excellent pipe configuration.

In the foregoing description, steel pipes are specifically mentioned as the pipes to which the invention is applied. This, however, is only illustrative and the invention may be applied equally well to the production of pipes of materials other than steel, e.g., copper, aluminum, titanium, brass and so forth.

The mentioned hydraulic drafting device and driving motor also are illustrative, and various other actuators may be used for the purpose of tightening the upper roll and for changing the lower roll spacing. Further, although the lower rolls are power-driven while the upper roll is used as a tightening roll, this is not exclusive and other arrangements that produce an equivalent effect can also be adopted.

Thus, in accordance with the present invention, it is possible to reduce the load applied to the counter roll during pipe forming work performed by bending rolls, thus suppressing deflection of the counter roll in a pass which may be the final pass. It is therefore possible to suppress creation of end gap at the longitudinally central region of the pipe, thus enabling production of high-strength, thick-walled elongated pipes having excellent pipe configurations.

Third Aspect

Embodiment 3

Figure 28:
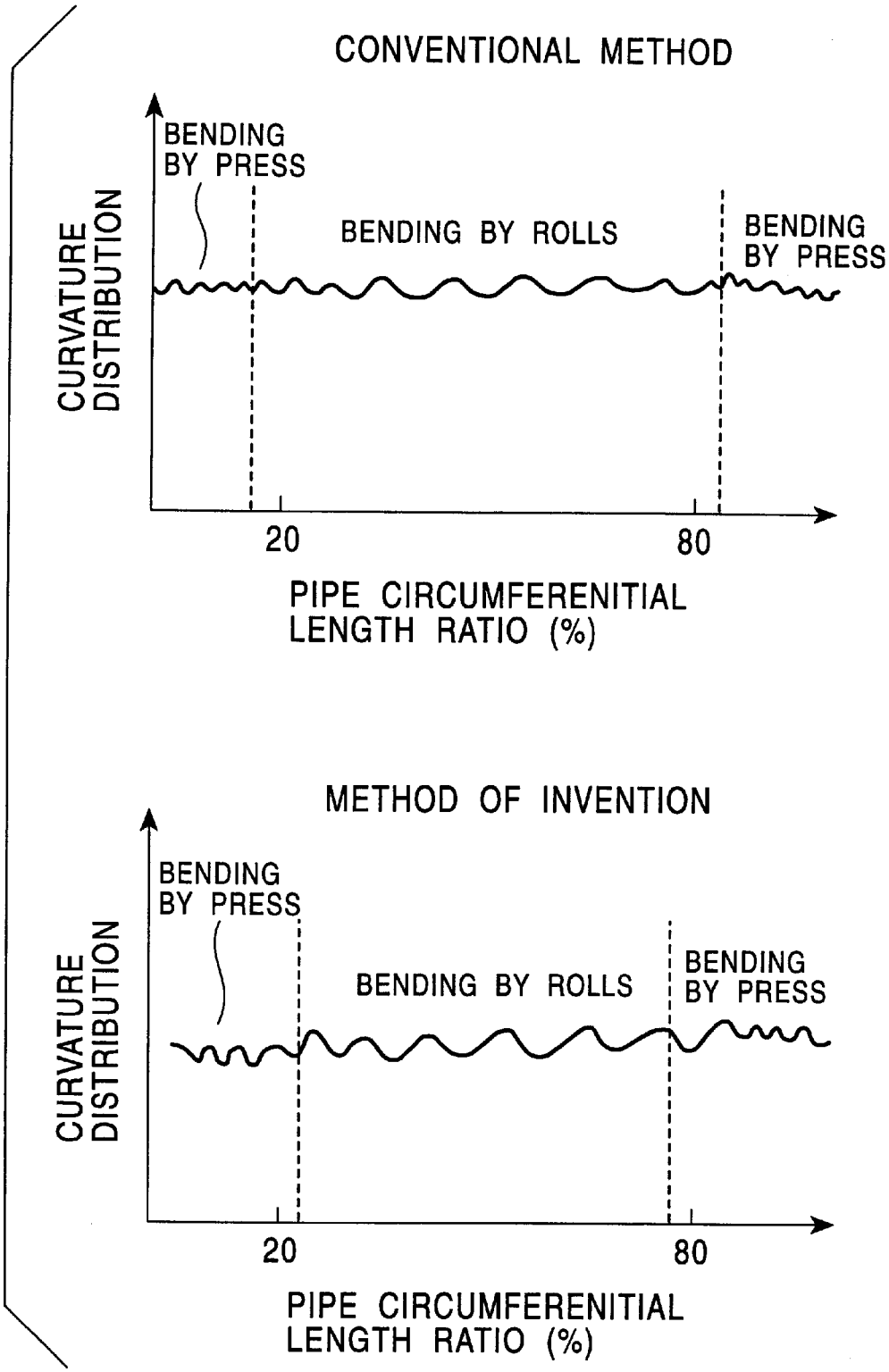
FIG. 28 is an illustration of a curvature distribution of a pipe formed in accordance with an embodiment of the present invention, in comparison with that obtained with a pipe formed by a conventional method.

The curvature distribution of the pipe formed in accordance with the invention is shown in FIG. 28, together with that obtained with a conventional method, for the purpose of comparison.

A high-tension steel sheet 30 mm thick and 6000 mm wide was cut into blank sheets of a length corresponding to the diameter of a pipe to be produced. The leading and trailing end regions of the blank sheets were pre-formed into arcuate form by a hydraulic press 42 of the type shown in FIG. 3. The thus-pre-worked steel sheets were then subjected to bending with a roll bender 30 in accordance with the invention, so as to be formed into pipes of 500 mm. The diameter Dwu of the upper roll and the diameter Dwl of the lower rolls were 400 mm and 350 mm, respectively. The pipe forming work was executed under the following three different conditions.

(1) Comparative Example

The length of each end region bent by the press was set to be ⅙ the entire circumference of the pipe, and the pipe forming bending work was conducted while setting the lower roll spacing to 600 mm.

(2) Inventive Example 1

The length of each end region bent by the press was set to be ¼ the entire circumference of the pipe, and the pipe forming bending work was conducted while setting the lower roll spacing to 600 mm and suspending the operation of the rolls such that the circumferential length of the region bent by the rolls is ½ the entire circumference of the pipe.

(3) Inventive Example 2

Figure 29:
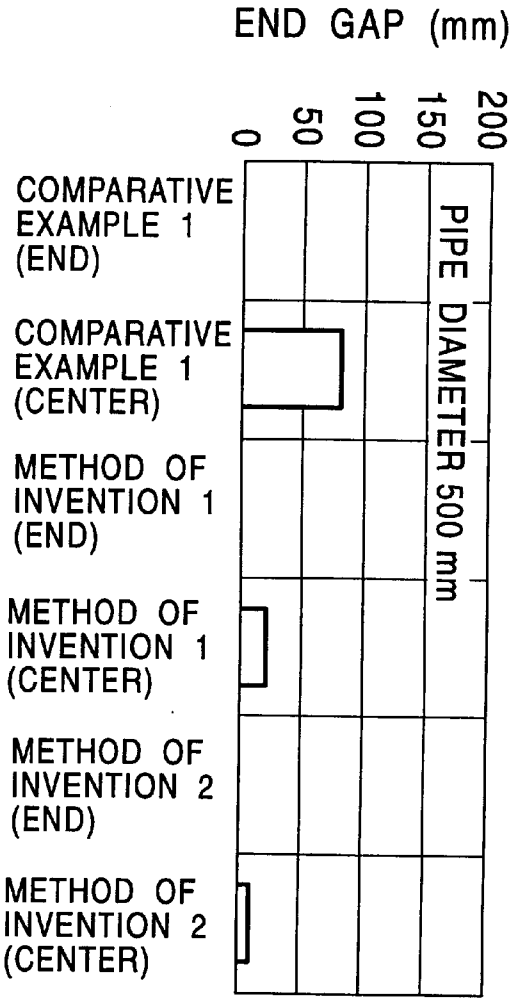
FIG. 29 is a chart showing the amounts of end gaps in pipes of 500 mm diameter produced in accordance with the method of the invention in comparison with those of pipes produced in accordance with Comparative Examples.

The length of each end region bent by the press was set to be ¼ the entire circumference of the pipe, and the pipe forming bending work was conducted while setting the lower roll spacing to 800 mm and suspending the operation of the rolls such that the circumferential length of the region bent by the rolls is ½ the entire circumference of the pipe. The amounts of end gaps in the pipes produced under these different conditions are shown in FIG. 29 for comparison.

In the Comparative Example, the difference in the size of the end gap between the longitudinally central region and end regions was as large as 80 mm and, hence, the pipe was unacceptable as a commercial product. This is attributable to a too large load applied in the course of the bending. In Inventive Example 1, the difference in the size of the end gap between the longitudinal center and both longitudinal ends of the pipe was reduced to 20 mm, so that the pipe could be used as a product, although the load applied during the pipe forming work was not so small. In Inventive Example 2, the load applied during the pipe forming work was also reduced significantly, so that the difference in the size of the end opening between the longitudinal center and both longitudinal ends of the pipe was further reduced to 10 mm, thus providing an excellent pipe configuration.

In the foregoing description, steel pipes are specifically mentioned as the pipes to which the invention is applied. This, however, is only illustrative and the invention may be applied equally well to the production of pipes of materials other than steel, e.g., copper, aluminum, titanium, brass and so forth.

The mentioned hydraulic drafting device and driving motor also are illustrative, and various other actuators may be used for the purpose of tightening the upper roll and for changing the lower roll spacing. Further, although the lower rolls are power-driven while the upper roll is used as a tightening roll, this is not exclusive and other arrangements that produce an equivalent effect can also be adopted.

Thus, in accordance with the present invention, it is possible to reduce the load applied to the rolls during pipe forming work, by virtue of the rigidity exhibited by the bent end regions that have been bent by, for example, the press. It is therefore possible to suppress creation of end gap at the longitudinally central region of the pipe, thus enabling production of high-strength, thick-walled elongated pipes having excellent pipe configurations.

What is claimed is:

1. A pipe forming apparatus comprising a pair of bending rolls arranged to work one side of a sheet of feed material, and a counter roll arranged to work the other side of said sheet, said apparatus further comprising:

a roll spacing setting device adapted to set the roll spacing of the pair of rolls to a value greater than the sum of the diameter of said counter roll and the diameter of one of said pair of rolls such that the spacing L of the pair of rolls satisfies the following expression:

$$(Dp+Dwl)>L\geqq 0.85(Dp+Dwl)$$

wherein Dp represents the outside diameter of the product pipe and Dwl represents the diameter of one of the pair of rolls; and a tightening amount setting device adapted to set the amount of movement of said counter roll relative to said pair of rolls to a value greater than the radius of one of said pair of rolls.

2. A pipe forming method for forming a pipe by roll bending, comprising the steps of:

forming a sheet of feed material into a pipe using a pipe forming apparatus according to claim 1, while setting the roll spacing between said pair of rolls to a value greater than the sum of the diameter of said counter roll and the diameter of one of said pair of rolls, and setting the amount of movement to a value greater than the radius of one of said pair of rolls.

3. A pipe forming method for forming a pipe by means of bending rolls, comprising the steps of:

forming a sheet of feed material into a pipe using the pipe forming apparatus according to claim 1 while maintaining the roll spacing between said pair of rolls greater than the sum of the diameter of said counter roll and the diameter of one of said pair of rolls, and progressively reducing the roll spacing in accordance with the progress of the passes so as to enable the amount of movement to be finally set to a value greater than the radius of one of said pair of rolls.

4. A pipe forming method according to claim 3, wherein, in earlier passes, the amount of movement is increased to a predetermined value greater than the radius of one of said pair of rolls, whereas, in later passes, the roll spacing is progressively decreased, thereby forming said sheet material into a pipe.

5. A pipe forming method for forming a pipe using a pipe forming apparatus having bending rolls including a pair of rolls arranged on one side of a sheet material, and a counter roll arranged at the other side of the sheet material, said pipe forming method comprising:

effecting pipe forming work on said sheet material such that the spacing L of the pair of rolls satisfies the following expression:

$$(Dp+Dwl)>L\geqq 0.85(Dp+Dwl)$$

wherein Dp represents the outside diameter of the product pipe and Dwl represents the diameter of one of the pair of rolls.

6. A pipe forming method according to claim 5, further comprising the steps of effecting correction of the bend by effecting roll bending to provide a curvature change which is not greater than 10% of the final curvature.

7. A pipe forming method for forming a pipe using a pipe forming apparatus using bending rolls including a plurality of rolls arranged on one side of a sheet material, and a counter roll arranged at the other side of the sheet material, said pipe forming method comprising:

providing a sheet of feed material having leading and trailing bent end regions each bent beforehand over a length not smaller than ⅕ of the entire circumference of the pipe to be produced; and effecting roll bending such that the length of the regions bent by the bending rolls is less than ⅗ the entire circumference of the pipe to be produced.

8. A pipe forming method according to claim 7, wherein operation of the bending rolls is suspended during passage of each of said bent end regions so as to avoid deformation of the bent end regions by the bending rolls, thereby ensuring that the length of the region bent by the bending rolls is less than ⅗ the entire circumference of the pipe to be produced.

9. A pipe forming method according to claim 7, wherein the roll spacing of said plural rolls is increased, thereby ensuring that the length of the region bent by the bending rolls is less than ⅗ the entire circumference of the pipe to be produced.

10. A pipe forming apparatus comprising a plurality of bending rolls arranged to work one side of a sheet of feed material, and a counter roll arranged to work the other side of said sheet at a position intermediate a pair of the plurality of rolls, said apparatus further comprising:

roll spacing setting means for setting the roll spacing of the pair of rolls to a value greater than the sum of the diameter of said counter roll and the diameter of one of said pair of rolls such that the spacing L of the pair of rolls satisfies the following expression:

$$(Dp+Dwl)>L\geqq 0.85(Dp+Dwl)$$

wherein Dp represents the outside diameter of the product pipe and Dwl represents the diameter of one of the pair of rolls; and tightening amount setting means for setting the amount of movement of said counter roll relative to said pair of rolls to a value greater than the radius of one of said pair of rolls.

* * * * *